US008171871B2

(12) United States Patent
Walderhaug

(10) Patent No.: US 8,171,871 B2
(45) Date of Patent: May 8, 2012

(54) ANCHOR HANDLING DEVICE

(75) Inventor: Sindre Walderhaug, Alesund (NO)

(73) Assignee: Rolls-Royce Marine AS, Alesund (NO)

( * ) Notice: Subject to any disclaimer, the term of this patent is extended or adjusted under 35 U.S.C. 154(b) by 203 days.

(21) Appl. No.: 12/666,455

(22) PCT Filed: Jun. 27, 2008

(86) PCT No.: PCT/NO2008/000247

§ 371 (c)(1),
(2), (4) Date: Dec. 23, 2009

(87) PCT Pub. No.: WO2009/005367

PCT Pub. Date: Jan. 8, 2009

(65) Prior Publication Data

US 2010/0319601 A1 Dec. 23, 2010

(30) Foreign Application Priority Data

Jul. 5, 2007 (NO) ..... 20073484

(51) Int. Cl.
*B63B 21/22* (2006.01)

(52) U.S. Cl. ..... 114/210

(58) Field of Classification Search ..... 114/210, 114/179, 181, 294, 218, 230.1, 268, 269, 114/368, 369, 364, 293, 310
See application file for complete search history.

(56) References Cited

U.S. PATENT DOCUMENTS

| | | | | | |
|---|---|---|---|---|---|
| 1,640,642 | A | * | 8/1927 | Brown | 180/14.1 |
| 3,070,355 | A | * | 12/1962 | Wyatt | 254/134.3 R |
| 3,074,370 | A | * | 1/1963 | Seiger | 114/210 |
| 3,704,680 | A | * | 12/1972 | Uher | 114/210 |
| 3,750,610 | A | | 8/1973 | Davis | |
| 4,479,452 | A | * | 10/1984 | Awalt, Jr. | 114/210 |
| 4,556,007 | A | | 12/1985 | Awalt, Jr. | |

FOREIGN PATENT DOCUMENTS

| | | | |
|---|---|---|---|
| AU | 50904/79 | A | 3/1980 |
| FR | 2835234 | A1 | 8/2003 |
| NO | 20041314 | | 9/2005 |
| WO | WO-2006/073316 | A1 | 7/2006 |

OTHER PUBLICATIONS

Gardel, Antony, International Search Report for PCT/NO2008/000247 as mailed Apr. 29, 2009 (3 pages).

* cited by examiner

*Primary Examiner* — Daniel Venne
*Assistant Examiner* — Andrew Polay
(74) *Attorney, Agent, or Firm* — Winstead PC

(57) ABSTRACT

An anchor handling device for an anchor handling vessel, the anchor handling device being adopted to bring an anchor from a substantially horizontal position resting at an aft deck of the vessel, to a substantially vertical position hanging astern of the vessel, wherein the device comprises two arms (7, 7') which at first ends are pivotally arranged about a substantially horizontal axis being substantially perpendicular to the length axis of the vessel, and which axis substantially coincides with a rotational of a stern roller (4) arranged at the aft end of a cargo deck (2) of the vessel, and where the arms (7, 7') at their second ends support an anchor handling roller (8) having an axis of rotation being substantially parallel to the axis of rotation for the arms (7, 7'), is described.

5 Claims, 7 Drawing Sheets

ANCHOR HANDLING DEVICE

TECHNICAL FIELD

The present invention relates to a method and device for safe handling of a heavy load or cargo that is taken up from below sea level to the deck of a vessel, or put out from the deck to the sea, respectively. More specifically, the present invention relates to a method and a device for anchor handling, where special care is taken for the security and equipment.

BACKGROUND ART

Floating offshore installation for the oil and gas exploration, development of oil and gas fields and exploration of oil and gas, are kept in position by means of anchors. The anchors are placed at the sea bed, moved and taken up by means of supply ships and anchor handling ships.

The anchors are lifted and lowered by means of wires operated by winches at the deck level of the supply or anchor handling ship. The wire used to lift an anchor is normally operated by a winch placed close to the forward end of the cargo deck. The wire runs over the deck and over a redirecting body or roller at the rear end of the cargo deck. One of the critical operations in anchor handling are bringing the anchor from the sea on board the ship, and bringing the anchor from the ship's deck out in the sea, respectively. During this phase the anchor, the wire and the winch are exposed for greater forces than during other parts of the operation.

The result of this imbalance is that the wire has to be dimensioned for the force that is necessary during the above mentioned critical operations. Additionally, there is a danger for the wire to break. A wire that breaks during this kind of stress represents a great danger for the ship, equipment and personnel. Additionally, the anchor could cause severe damage to subsea installations below the ship.

NO 2004 1314 describes a ramp for handling of rig anchors on a supply ship. The ramp has two rollers, a lower roller and an upper roller, where the ramp may be pivotally rotated about the axis of the lower roller between an upper position where the ramp has an angle relative to the horizontal plane of about 60°, and a lower position having an angle of about 30°. Even though the forces caused by the anchor during the above mentioned phase is substantially reduced, compared with the old method, the forces are still high and the safety risks caused by the high forces are still present.

WO2006/073316 relates to a safe anchor handling device and methods for putting an anchor out into the sea from the deck of a vessel, and taking an anchor onboard a deck of a vessel, respectively. The device comprises a ram having a resting surface for an anchor, where the rain is displaceable from an inboard position where the resting surface is substantially horizontal, and an outboard position where the resting surface is substantially vertical. This ramp avoids the problem mentioned above related to bringing the anchor from the sea and onto the deck and bringing the anchor from the deck an out into the sea. The ramp has, however, not been a success and has only been installed onboard one vessel. The main problems are that the ramp in its vertical position is regarded to constitute a safety risk in that it blocks the astern view the deck and bridge and thus the visual control with the operation, and that that the buoyancy at the aft part ov the vessel is substantially reduced. Additionally, the effective area of the cargo deck is reduced, a reduction that is negative for the use of the vessel for other purposes.

Additionally, the device according to WO2006/073316 has a relatively complex and heavy construction. Accordingly, there is also a need for a simplified and lighter solution.

Accordingly there is a need for a method and a device for avoiding the problems described above connected to the operations of taking the anchor onboard a ship and bringing the anchor from the deck of a ship out into the sea.

An object of the present invention is thus to provide an anchor handling device that overcomes the problems described above.

SUMMARY OF THE INVENTION

The object is solved by an anchor handling device for an anchor handling vessel, the anchor handling device being adopted to bring an anchor from a substantially horizontal position resting at an aft deck of the vessel, to a substantially vertical position hanging astern of the vessel, wherein the device comprises two arms which at first ends are pivotally arranged about a substantially horizontal axis being substantially perpendicular to the length axis of the vessel, and which axis substantially coincides with a rotational of a stern roller arranged at the aft end of a cargo deck of the vessel, and where the arms at their second ends support an anchor handling roller having an axis of rotation being substantially parallel to the axis of rotation for the arms. The present solution using a pivotally arranged arms supporting an anchor handling roller makes it possible to take an anchor on board the vessel or put an anchor from the cargo deck of the vessel out into the sea without external help from a platform or ship using a crane, and without exposing the equipment for the extreme forces mentioned above. Additionally, this construction is simple and not to heavy and does not prevent the necessary aft view from the cargo deck to and bridge of the vessel.

According to one embodiment, the arms and the anchor handling roller are adopted to be rotated from a stowed away position where the arms and the anchor handling roller are arranged in channels in the cargo deck, and an active position where the aft vertical tangent of the anchor handling roller coincides or is astern of the aft vertical tangent of the stern roller. When the anchor handling device is in its stowed away position, the use of the cargo deck is not limited by the anchor handling device and the vessel may be used for other purposes.

According to one embodiment, the arms are rotated by means of hydraulic activator(s). Even though the arms may be rotated by alternative means, hydraulic actuators are the preferred rotating means, as they are simple, and reliable.

According to one embodiment, the arms are fixed to a rotating shaft. When the arms are fixed to a rotating shaft, the arms will be moved parallel to each other. If an actuator controlling one of the arms is damaged, both arms may be controlled by the actuator controlling the other arm. Additionally, the total force needed to control the arms is distributed by the rotating means, making advanced systems to control the position of each arm superfluous According to another embodiment, the arms are rotary connected to a rotating shaft.

The stern roller is preferably rotary arranged on the rotating shaft.

The anchor handling device is adopted to fit into one or more recess(es) in the cargo deck when the device is in a stowed position. This makes it possible to stow away the anchor handling device so that it does not obstruct any other operations when the device is not in use. This makes the vessel more suited for different tasks as it leaves the cargo deck as an effective and functional cargo deck for other tasks that the vessel may be assigned to. This is also an important safety issue, as devices at deck may cause problems for the people working on the deck.

DETAILED DESCRIPTION OF THE INVENTION

Figure 1:
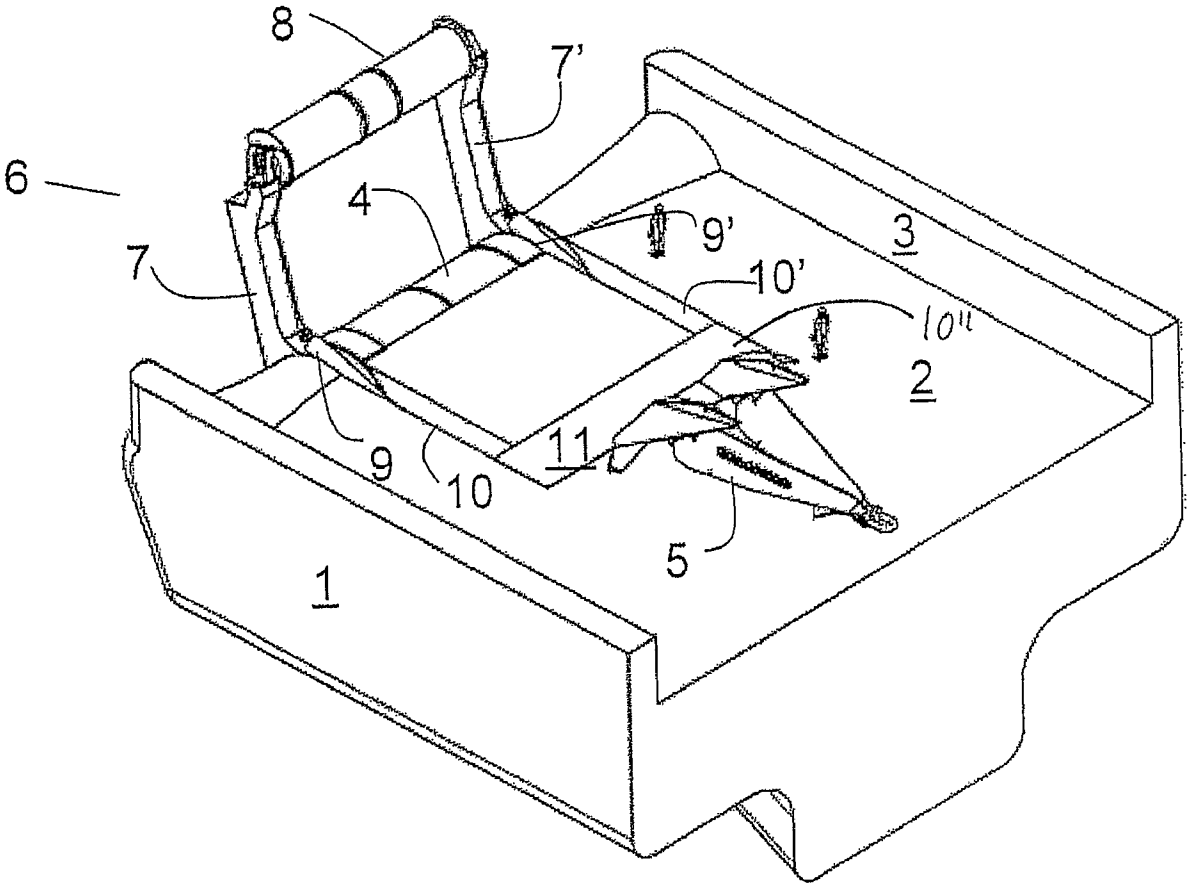
FIG. 1 is a perspective drawing of a cargo deck on an anchor handling vessel illustrating an embodiment of the present device.
Figure 2:
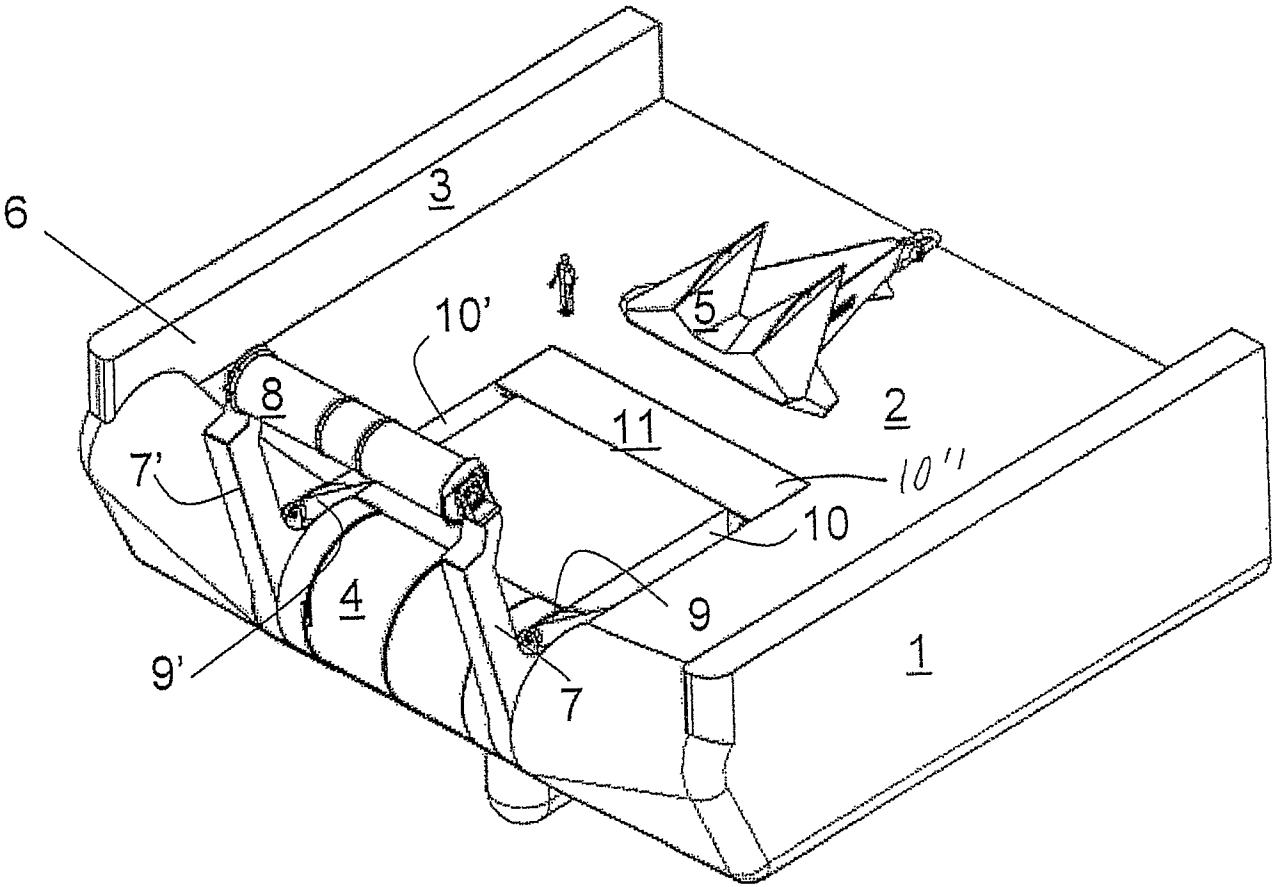
FIG. 2 is a perspective drawing of the device illustrated in FIG. 1, from another angle.

A preferred embodiment of the present anchor handling device is illustrated in the drawings and will be described in detail below.

FIG. 1 is a perspective drawing of the aft part of an anchor handling vessel 1, being equipped with an anchor handling system 6 according the present invention. The vessel 1 has an open cargo deck 2, being limited at both sides by cargo rails 3, and at the stern, by a stern roller 4 rotary about an axis that is substantially horizontal and normal to the length axis of the ship. An anchor 5 for a floating offshore installation is shown at the cargo deck 2.

The anchor handling device comprises two arms 7, 7', 15 supporting an anchor handling roller 8. The arms 7, 7', 15 is rotary arranged about an axis that is substantially parallel to or coincides with the axis of rotation for the stern roller 4. The two arms 7, 7' are both preferably fixed to the shaft 15. The shaft 15 is preferably a hollow shaft that is rotary arranged at the stern of the vessel, e.g. on a not shown stern shaft. The stern roller is again, preferably, rotary connected to the shaft 15.

Figure 3:
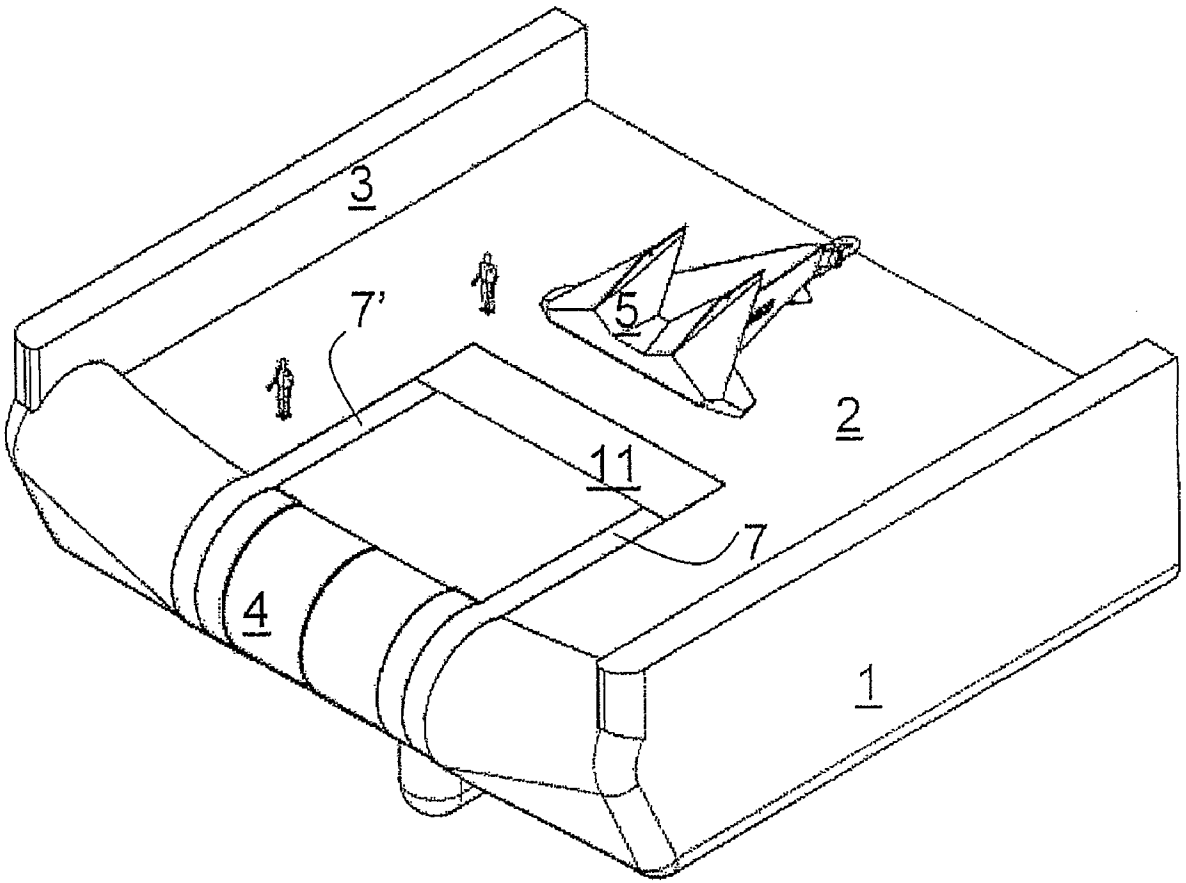
FIG. 3 is a perspective drawing corresponding to FIG. 2, where the present device is in a stowed position.
Figure 4:
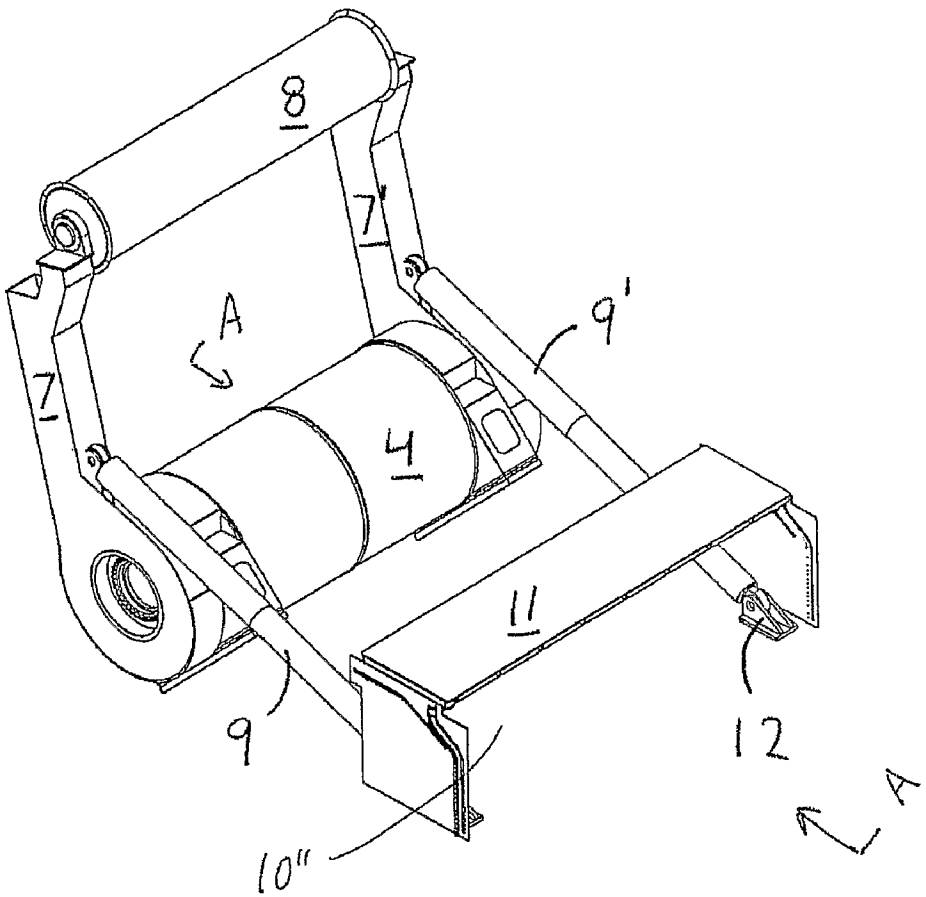
FIG. 4 is a perspective view of the present device in an active, or outer, position.
Figure 5:
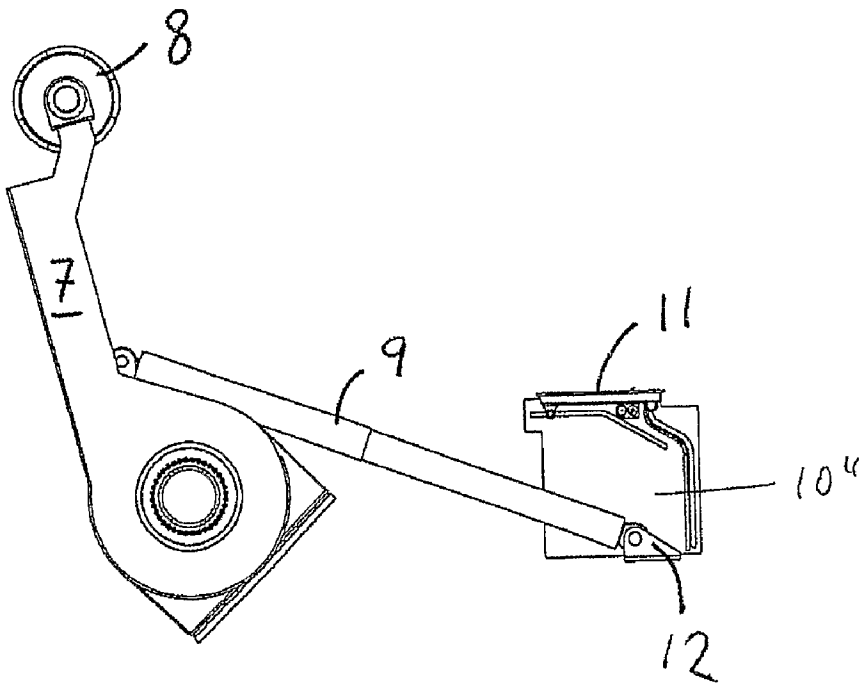
FIG. 5 is a side view of the device according to FIG. 4.
Figure 6:
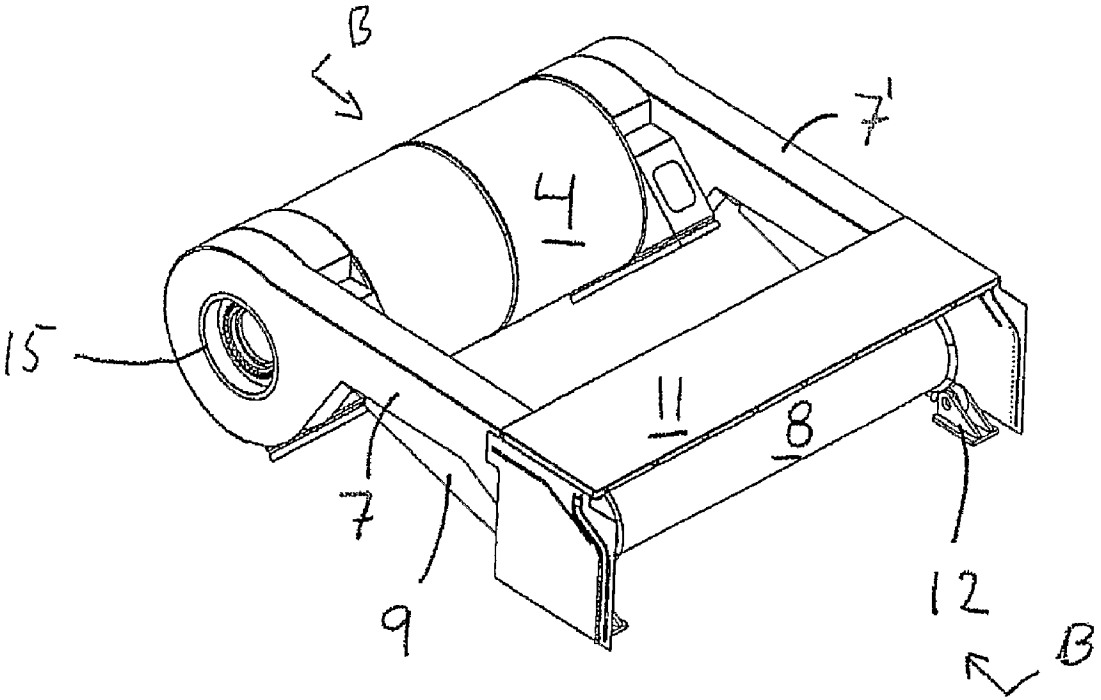
FIG. 6 is a perspective view of the present device in a stowed position.
Figure 7:
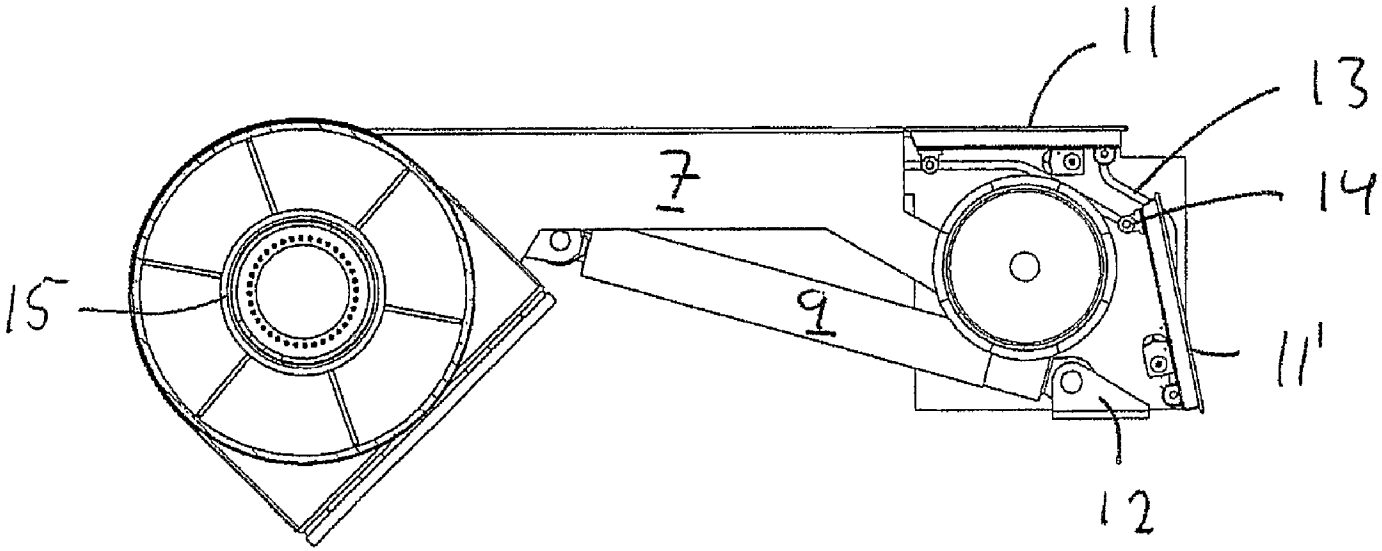
FIG. 7 is a cross section along B-B in FIG. 6.

The arms 7, 7', 15 are controlled by means of actuators 9, 9', that are arranged to pivotally rotate the arms 7, 7' between an active or outer position as illustrated in e.g. FIGS. 4 and 5, and stowed position as illustrated in FIGS. 3, 6 and 7, where the anchor handling device is stored below the cargo deck. As the arms 7, 7' and the shaft 15 are fixed to each other, the arms 7, 7', the anchor handing roller 8, and the shaft 15 forms and rotates like an integrated unit. The forces that are necessary to rotate and to hold the arms in the desired position are therefore balanced between the actuators 9, 9'. Accordingly, if one of the actuators is damaged of losses the hydraulic pressure, the frame may still be controlled by the other actuator.

Channels 10, 10' and 10" to receive the frame 7, 7' and the anchor handling roller 8 when they are in the stowed position, are provided in the cargo deck 2. The two arms 7, 7' are parallel to each other. Consequently, the channels 10 and 10' are parallel with each other and with the length axis of the vessel, and are adopted to receive the two arms of the frame 7, 7'. The third channel, channel 10", connects the channels 10 and 10', and is adopted to receive the anchor handling roller 8. A cover 11 is preferably provided to cover the channel 10".

FIG. 7 illustrates the cover 11 both in an upper position marked 11, where the cover is covering the channel 10", and a lower position marked 11'. The cover 11 is guided by means of guide wheels 14 fitted into guide grooves when it is moved from the lower position into the upper position.

The arms 7, 7' are preferably designed so that the upper sides of the arms are in level with the cargo deck to form a cover for the channels 10, 10' when the arms are in the stowed position.

As mentioned above, the arms 7, 7', and thus the anchor handling device 6, are operated by means of two hydraulic actuators 9, 9' connected to the arms 7, 7' and to brackets 12 in the channels 10, 10', and/or 10". In the active, or outer, position, of the anchor handling device 6, a vertical tangent of the anchor handling roller 8 preferably coincides with, or is astern of the vertical tangent of the stern roller. Preferably, the mentioned tangent of the anchor handling roller 8 is astern of the corresponding tangent of the stern roller. When the anchor handling roller 8 is astern of the stern roller 4, an anchor hanging in a wire that passes over the anchor handling roller will not rest against the stern roller. The distance between the stern roller and the vertical tangent of the anchor handling roller, gives space for handling of the anchor, such as turning the anchor, before it is hoisted up to the anchor handling roller. The anchor may be turned by the slipstream of the propellers of the ship if the lower part of the anchor is below sea level and the top of the anchor is hanging free from the stern roller. It is therefore preferred that the horizontal distance between the vertical aft tangent of the anchor handling roller is as long as possible.

An anchor hanging in a wire going over the anchor handling roller will create two forces on the anchor handling device, one vertical force created by gravity, and a substantially horizontal force, created by the winch. The direction of the force caused by the wire may differ from the horizontal plane depending on the height above the deck of the anchor handling roller and the distance and height above the deck of the winch. The two forces will balance each other when the frame has an outward angle of about 45° from a horizontal plane, corresponding to an inwards angle relative to the cargo deck being substantially horizontal of about 135°. For a device according to the present invention where the frame is controlled by means of hydraulic actuators, it is preferred that the actuators always are pushing when under load. Accordingly, the maximum angle opening towards the cargo deck is about 135°.

In the stowed position of the anchor handling device, an anchor may be placed over the stern roller and the anchor handling roller. After removal of the cover 11, the anchor handling device may activated, i.e. the hydraulic activators are activated to lift the free end of the arms 7, 7' including the anchor handling roller from the stowed position to the activated, or outer, position described above. During the pivoting movement of the anchor handling device from the stowed position to the outer position, the anchor is held in place and prevented from sliding of the device by means of a wire fastened to the top of the anchor that runs over the anchor handling roller 8 and is held tight by means of a not shown winch. When the anchor handling device is in the active or outer position, the anchor may be lowered by means of the said wire and winch without causing any breaking forces at the anchor. As soon as the anchor is below the stem roller, the anchor handling device may be lowered into its stowed position.

The present anchor handling device 6 may also be locked in any intermediate position between the above described active position and its stowed away position. A presently preferred intermediate position, or spooling position, is a position where the angle between the cargo deck and the arms are between 10 and 90°, such as e.g. between 15 and 45°, or between 20 and 30°. In the spooling position the channels 10, 10', 10", may be covered by covers, such as the cover 11, to allow the crew to work safely at the aft deck. In the spooling position the anchor handling roller 8 may be used as a spool to redirect a rope, wire or the like. A rope or wire from a winch at the forward part of the cargo deck may be laid over the anchor handling roller, to an anchor placed on the deck for pulling the anchor aft at the deck. If the anchor has a size that allows the anchor to pass between the arms 7, 7' and below the anchor roller 8, the anchor may be pulled into a position to be put out without using other tools. The use of the anchor handling device to reposition an anchor in this way adds an additional advantage by reducing the need for additional tools for this repositioning on board the vessel.

The procedure for taking up an anchor is opposite of the above described procedure. When an anchor is to be taken up, the anchor is hoisted up towards the ship by means of a wire running over the stem roller to a winch. When the anchor approaches the surface, the anchor handling device is moved from its stowed position to the activated, or outer, position, so that the wire runs over the anchor handling roller. The anchor may then be hoisted up in a position where a part of the anchor rests against the stem roller and the upper part of the anchor rests against the anchor handling roller. The wire is kept tight to keep the anchor steady at the anchor handling device as it is returned to the stowed position. As soon as the anchor handling device is returned to the stowed position, the anchor may be relocated at the cargo deck if necessary.

During the mentioned operations, the anchor is also connected to a chain in addition to one or more ropes. The handling of the ropes and chain is not described as it is not important for the understanding of the present invention. Additionally, the skilled man in the art will understand which adjustments that may be necessary for the handling of the chain and ropes in using the present device.

The skilled man in the art will understand the illustrated embodiment is only an example of a possible embodiment of the present invention and that several other embodiments are possible without leaving the scope of the protection as defined in the attached claims. The frame illustrated in the drawings, comprises two parallel arms that may be integrated in the deck of the vessel. The arms 7, 7' in the illustrated embodiment are parallel but this is not a requirement. The illustrated anchor handling roller has the same length as the stern roller. The anchor handling roller may, however, be shorter and even longer than the stern roller. The construction of the device and the relative lengths of the rollers are thus a question of the actual need and preferences for a given vessel. The described device is fitted into channels in the deck. It will also be possible to lower the anchor handling device into a recess in the deck and cover the device if required.

The skilled man in the art would also understand that the frame may be controlled by other means than hydraulic actuators. Even though hydraulic actuators are presently preferred, the frame may be controlled by a motor via e.g. a gear transmission or a chain transmission. Additionally, the skilled man will also understand that the anchor handling device may also be used to put out and take up other heavy bodies than an anchor without leaving the scope of the invention.

The invention claimed is:

1. An anchor handling device for an anchor handling vessel, the anchor handling device bringing an anchor from a substantially horizontal position resting at an aft deck of the vessel, to a substantially vertical position hanging astern of the vessel, wherein the device comprises two arms which at first ends are pivotally arranged about a substantially horizontal axis being substantially perpendicular to the length axis of the vessel, and which substantially horizontal axis substantially coincides with a rotational axis of a stern roller arranged at the aft end of a cargo deck of the vessel, and where the arms at their second ends support an anchor handling roller having an axis of rotation being substantially parallel to the axis of rotation for the arms and wherein the arms and the anchor handling roller are rotated from a stowed away position where the arms and the anchor handling roller are arranged in channels in the cargo deck, and an active position where an aft vertical tangent of the anchor handling roller coincides or is astern of an aft vertical tangent of the stern roller.

2. The device according to claim 1, wherein the arms are rotated by means of hydraulic actuators.

3. The device according to claim 1, wherein the arms are fixed to a rotating shaft.

4. The device according to claim 1, wherein the arms are rotary connected to a rotating shaft.

5. The device according to claim 4, wherein the stern roller is rotary arranged about the rotating shaft.

* * * * *

UNITED STATES PATENT AND TRADEMARK OFFICE

CERTIFICATE OF CORRECTION

PATENT NO. : 8,171,871 B2
APPLICATION NO. : 12/666455
DATED : May 8, 2012
INVENTOR(S) : Sindre Walderhaug It is certified that error appears in the above-identified patent and that said Letters Patent is hereby corrected as shown below:

Column 1, Line 53

Replace "the rain is displaceable"
With -- the ram is displaceable --

Column 2, Line 34

Replace "cargo deck to and bridge"
With -- cargo deck and bridge --

Column 4, Line 59

Replace "the stem roller,"
With -- the stern roller, --

Column 5, Line 18

Replace "the stem roller"
With -- the stern roller --

Column 5, Line 23

Replace "the stem roller"
With -- the stern roller --

Signed and Sealed this
Thirteenth Day of November, 2012

David J. Kappos

David J. Kappos
*Director of the United States Patent and Trademark Office*